US009695652B2

(12) United States Patent
Misselbrook et al.

(10) Patent No.: US 9,695,652 B2
(45) Date of Patent: Jul. 4, 2017

(54) SYSTEM AND METHOD FOR SPLICING A NON-SPOOLABLE TOOL ANYWHERE ALONG A COILED TUBING STRING

(71) Applicant: BAKER HUGHES INCORPORATED, Houston, TX (US)

(72) Inventors: John G. Misselbrook, Calgary (CA); Craig Chabert, London (GB)

(73) Assignee: Baker Hughes Imcorporated, Houston, TX (US)

( * ) Notice: Subject to any disclaimer, the term of this patent is extended or adjusted under 35 U.S.C. 154(b) by 323 days.

(21) Appl. No.: 14/219,592

(22) Filed: Mar. 19, 2014

(65) Prior Publication Data

US 2014/0311754 A1 Oct. 23, 2014

Related U.S. Application Data

(60) Provisional application No. 61/814,461, filed on Apr. 22, 2013.

(51) Int. Cl.
*E21B 19/22* (2006.01)
*E21B 17/04* (2006.01)

(52) U.S. Cl.
CPC ..... *E21B 19/22* (2013.01); *E21B 17/04* (2013.01)

(58) Field of Classification Search
CPC ..... E21B 17/02; E21B 17/20; E21B 19/086; E21B 19/22; E21B 17/04
See application file for complete search history.

(56) References Cited

U.S. PATENT DOCUMENTS 3,298,213 A * 1/1967 Szel ..... B23D 21/00 29/566
4,515,220 A * 5/1985 Sizer ..... B65H 51/14 166/384
4,940,095 A * 7/1990 Newman ..... E21B 19/22 166/378
5,415,441 A * 5/1995 Kilgore ..... E21B 17/04 285/322

(Continued)

OTHER PUBLICATIONS

International Search Report and Written Opinion; Jan. 23, 2015; International Application No. PCT/US2014/031348.

(Continued)

*Primary Examiner* — David Andrews
*Assistant Examiner* — Kristyn Hall
(74) *Attorney, Agent, or Firm* — Parsons Behle & Latimer

(57) ABSTRACT

A system and method for splicing a non-spoolable tool anywhere along a coiled tubing string. A removable tubing section may be connected along a coiled tubing string by two spoolable connectors. The coiled tubing string may be unspooled from a reel until the removable tubing section and connectors are positioned within a work window. The removable tubing section may be disconnected from the tubing string through the work window and a tool may be connected to the coiled tubing string via the two connectors. The tool may then be positioned within a wellbore by insertion of the coiled tubing string. The tool may aid in the insertion of the coiled tubing string into the wellbore. A portion of the wellhead may be disconnected and raised to expose the connectors to permit the removal of the removable tubing section and the connection of a non-spoolable tool.

6 Claims, 6 Drawing Sheets

(56) References Cited

U.S. PATENT DOCUMENTS

| | | | | |
|---|---|---|---|---|
| 5,988,702 | A * | 11/1999 | Sas-Jaworsky | E21B 17/02 285/222.1 |
| 6,561,278 | B2 | 5/2003 | Restarick et al. | |
| 2004/0251022 | A1 * | 12/2004 | Smith | E21B 49/087 166/250.17 |
| 2005/0274527 | A1 * | 12/2005 | Misselbrook | E21B 17/203 166/369 |
| 2006/0243453 | A1 | 11/2006 | Mckee | |
| 2007/0187111 | A1 | 8/2007 | Misselbrook et al. | |
| 2007/0235198 | A1 * | 10/2007 | Parker | E21B 17/046 166/380 |
| 2008/0169650 | A1 | 7/2008 | Webb et al. | |

OTHER PUBLICATIONS

European Patent Office; Office Action for European Patent Application No. 14720016.6 dated Mar. 22, 2017.

* cited by examiner

SYSTEM AND METHOD FOR SPLICING A NON-SPOOLABLE TOOL ANYWHERE ALONG A COILED TUBING STRING

REFERENCE TO RELATED APPLICATIONS

The present application claims the benefit of priority under 35 U.S.C. §119 to U.S. Provisional Application No. 61/814,461 filed Apr. 22, 2013, entitled "SYSTEM AND METHOD FOR SPLICING A NON-SPOOLABLE TOOL ANYWHERE ALONG A COILED TUBING STRING," which is incorporated by reference herein in its entirety.

FIELD OF THE DISCLOSURE

The embodiments described herein relate to a system and method for splicing a non-spoolable tool along a coiled tubing string.

BACKGROUND

Description of the Related Art

Coiled tubing may be run into a wellbore for various intervention and/or maintenance purposes. For example, coiled tubing may be used for cleaning out debris from the wellbore or stimulation of the producing formation. Coiled tubing may be spooled onto a single reel or if weight constraints exist, onto multiple reels to facilitate transport to location prior to assembling the sections into one string and running the coiled tubing string into the wellbore. Due to the increasing lengths of wellbores, longer lengths of coiled tubing may be required to service a particular well often necessitating two or more spools of coiled tubing. The use of multiple spools to hold the coiled tubing string may be due to the lifting limitations of cranes used to hoist the spools of coiled tubing. The coiled tubing from both spools may then be spliced together to from a single string of coiled tubing prior to insertion of the coiled tubing string into the wellbore. Spoolable connectors such as those disclosed in U.S. Pat. No. 7,562,909 entitled "Composite Low Cycle Fatigue Coiled Tubing Connector," which is incorporated by reference herein in its entirety, may be used to splice together coiled tubing from multiple spools to form a single coiled tubing string.

A tool, such as a water hammer pulse tool or a tractor may be connected to the end of the coiled tubing string to aid in the insertion of the coiled tubing string into a wellbore. An example of a water hammer pulse tool is disclosed in U.S. Pat. No. 8,272,404 entitled "Fluidic Impulse Generator", which is incorporated by reference herein in its entirety. The tool to be attached to the end of the coiled tubing may be a non-spoolable tool meaning that the tool cannot be connected to the coiled tubing string and then be spooled onto a reel. Non-spoolable tools are generally too rigid to be bent with the coiled tubing as it is spooled onto a reel. The tool may also have a larger outer diameter than the outer diameter of the coiled tubing string and thus, may not be able to pass through the coiled tubing injector. Thus, such tools are generally attached to the end of the coiled tubing string after the end of the coiled tubing string has passed through the injector.

SUMMARY

The present disclosure is directed to attaching a non-spoolable tool at any point along a coiled tubing string. It may be desired to connect a tool to the coiled tubing string at any point along the tubing string instead of just connecting the tool to the end of the coiled tubing string. For example, it may be beneficial to add a second tool in the middle of the coiled tubing string to aid in the insertion of the coiled tubing string into a deep wellbore.

One embodiment is a method for splicing a tool along a coiled tubing string. The method includes unspooling the coiled tubing string from a reel. The coiled tubing string comprises a lower coiled tubing string connected to a lower connector, an upper coiled tubing string connected to an upper connector, and a removable tubing section connected between the lower and upper connectors. The method includes disconnecting an upper end of the removable tubing section from the upper connector and disconnecting a lower end of the removable tubing section from the lower connector. The method includes connecting an upper portion of the tool to the upper connector and connecting a lower portion of the tool to the lower connector.

The method may include inserting the coiled tubing string in a wellbore to position the tool within the wellbore. Unspooling the coiled tubing string may include running the coiled tubing string through a coiled tubing string injector and lubricator. Disconnecting the upper end and lower end of the removable tubing section may comprise machining out dimples from the removable tubing section. Connecting the upper and lower portions of the tool may comprise crimping the upper portion of the tool with a portion of the upper connector and crimping the lower portion of the tool with a portion of the lower connector.

One embodiment is a method for splicing a tool along a coiled tubing string comprising connecting an upper connector to an upper coiled tubing string and an upper portion of a removable coiled tubing section and connecting a lower connector to a lower coiled tubing string and a lower portion of the removable coiled tubing section to form a coiled tubing string comprising the upper coiled tubing string, removable coiled tubing section, and lower coiled tubing string. The method includes passing the lower connector, removable coiled tubing section, and upper connector through a coiled tubing injector head. The method includes disconnecting the removable coiled tubing section from the upper connector and the lower connector and removing the removable coiled tubing section from the coiled tubing string. The method includes connecting a tool to the upper connector and the lower connector.

The method may include positioning the removable coiled tubing section within a work window of a wellhead, wherein the removable coiled tubing section is removed from the work window. The method may include disconnecting the coiled tubing injector head and raising the coiled tubing injector head to expose the upper and lower connectors prior to disconnecting the removable coiled tubing section. The method may include securing the position of the coiled tubing string within a blow out preventer (BOP) and sealing against an exterior of the coiled tubing string within the BOP, wherein the securing and sealing are performed prior to disconnecting the removable coiled tubing section. The connections of the removable coiled tubing section to the upper and lower connectors may be dimple connections. The method may include machining out the dimple connections to remove the removable coiled tubing section. The method may include connecting the tool to the upper and lower connectors with dimple connections.

One embodiment is a system for connecting a tool along a coiled tubing string. The system includes a first connector, a second connector, and a removable section of tubing connecting to a coiled tubing string by the first and second connectors. The first connector, second connector, removable section of tubing, and the tubing string are adapted to be spooled onto a reel. The system includes a tool, a first connecting tube configured to connect the tool to the first connector after the removable section of tubing has been disconnected from the first connector, and a second connecting tube configured to connect the tool to the second connector after the removable section of tubing has been disconnected from the second connector. The tool is connected to the coiled tubing string by the first and second connectors when the first and second connectors are position of the reel.

The first connecting tube may include a first threaded end to connect to the tool and a second end that may be crimped to the first connector. The second connecting tube may include a first thread end to connect to the tool and a second end that is crimped to the second connector. The tool may be a rotary tool, a water hammer pulse tool, a circulating sub, or a gas lift sub. The system may include a work window that permits the connection of the tool to the tubing string through the work window. The system may include a BOP adapted to retain the coiled tubing string in a fixed position and adapted to provide a seal against an exterior of the coiled tubing string prior to the disconnection of the removable section of tubing.

The system may include a third connector, a fourth connector, and a second removable section of tubing connected to the tubing string by the third and fourth connectors. The third connector, the fourth connector, second removable section of tubing, and the tubing string may be adapted to be spooled onto the reel. The system may include a second tool, a third connecting tubing, and a fourth connecting tube. The third connecting tube may be configured to connect the second tool to the third connector after the second removable section of tubing has been disconnected from the third connector. The fourth connecting tube may be configured to connect the second tool to the fourth connector after the second removable section of tubing has been disconnected from the fourth connector. The second tool may be connected to the coiled tubing string by the third and fourth connectors when the third and fourth connectors are positioned off of the reel.

Figure 1:
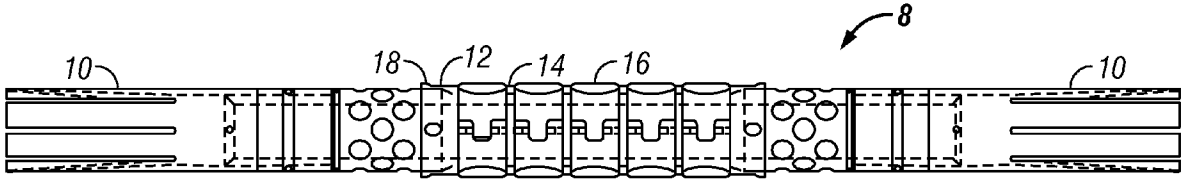
FIG. 1 is a side view of a connector that may be used to connect a tool along a coiled tubing string.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

It may be desired to attach a rigid tool to a position somewhere along the length of coiled tubing string that may not be able to be spooled onto a coiled tubing reel. One embodiment of the present disclosure is the method of connecting a tool anywhere along a coiled tubing string using connectors that are flexible and may be spooled onto a coiled tubing reel. The connectors may be positioned anywhere along the coiled tubing string where it may be desired to attach a downhole tool after the specified position of the coiled tubing string has been spooled off of the reel. The connectors may be used to connect a tool that aids in the insertion of the coiled tubing into a wellbore such as a water pulse hammer tool. The connectors may be used to connect various tools, and not just a water pulse hammer tool, to the coiled tubing string as would be appreciated by one of ordinary skill in the art having the benefit of this disclosure. For example, the connectors may be used to connect a rotary tool or a downhole tractor or any other tool dimensioned to fit within the wellbore to a desired location along a coiled tubing string. The connectors may also be used to connect a circulating sub or gas lift sub anywhere along a coiled tubing string.

Figure 7:
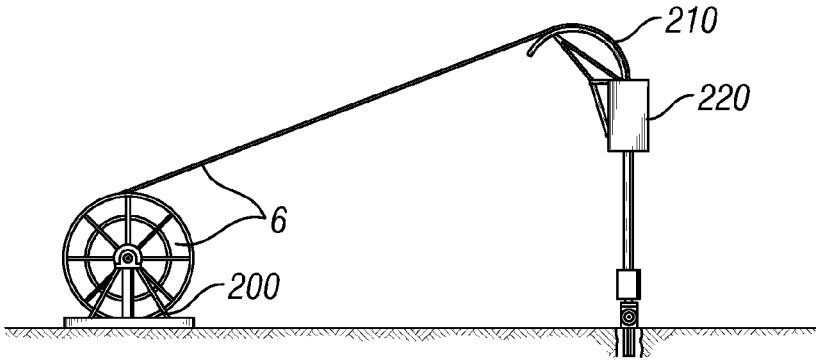
FIG. 7 shows coiled tubing from a reel passing through a coiled tubing injector head and into a wellhead.
Figure 8:
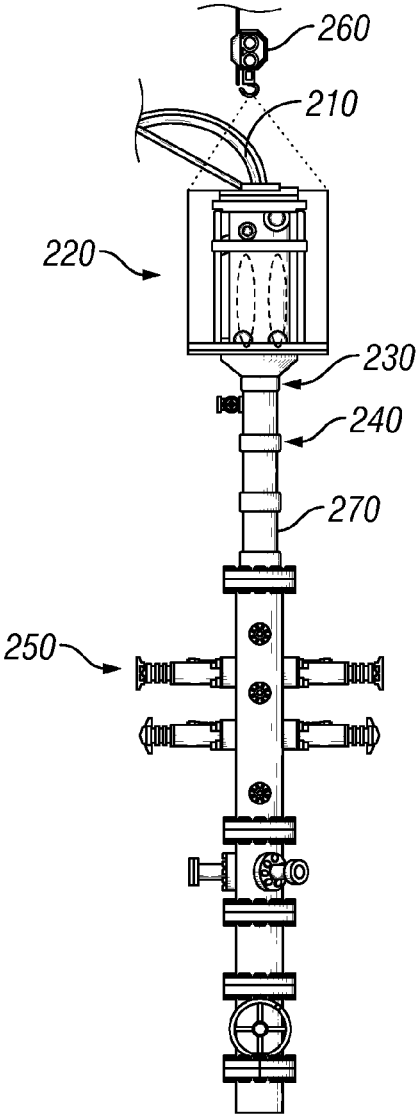
FIG. 8 shows coiled tubing passing through a coiled tubing injector head being suspended from a crane.

FIG. 1 is shows one embodiment of a connector 8 that may be used to connect a tool along the coiled tubing string 6 (Shown in FIG. 7). The connector 8 includes entry sections 10 that are used to connect the connector 8 to coiled tubing 6. The entry sections 10 are located at the ends of the body 14 of the connector 8. The connector 8 includes shoulders 18 and an annular void between the shoulders 18. An elastomer backfill 12 and centralizers 16 fills the annular void between the shoulders 18. The outer diameter of the body 14 of the connector 8 is less than that of the outer diameter of the coiled tubing 6. The elastomer backfill 12 and centralizers 16 help to centralize the connector 8 as it passes through the stuffing box 230 (shown in FIG. 8) and blow out preventer 250 (shown in FIG. 8). A plurality of connectors 8 may be used to selectively connect a removable tubing section 106 (shown in FIGS. 2-3) and selectively connect a tool after removing the removable tubing section 106 as will be described in detail herein.

Figure 2:
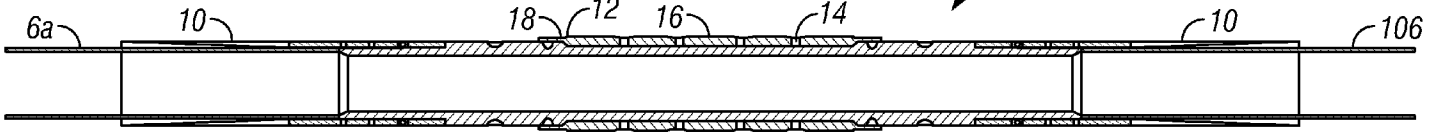
FIG. 2 is a cross-sectional view of an upper connector connected to a coiled tubing string on the upper end and connected to short removable tubing section on the lower end.
Figure 3:
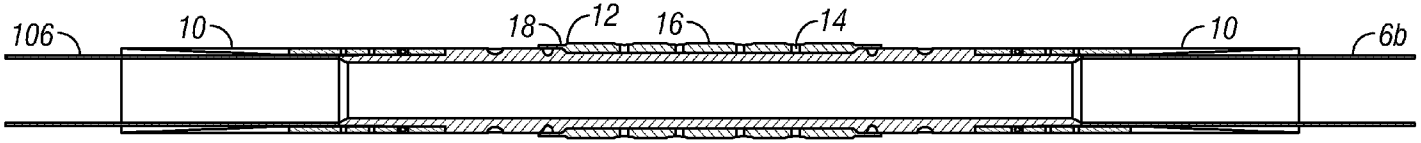
FIG. 3 is a cross-sectional view of a lower connector connected to a coiled tubing string on the lower end and connected to short removable tubing section on the upper end.

FIG. 2 shows an upper connector 8*a* connected on a first end to an upper coiled tubing string 6*a* and connected on a second end to a removable tubing section 106. The removable tubing section 106 may be connected to a lower coiled tubing string 6*b* via a lower connector 8*b* as shown in FIG. 3. The lower tubing string 6*b*, lower connector 8*b*, removable tubing section 106, upper connector 8*a*, and upper tubing sting 6*a* may be connected together to form a coiled tubing string 6 that may be spooled onto a reel 200 (shown in FIG. 7). After unspooling the portion of the coiled tubing string 6 that includes the connectors 8*a* and 8*b* and the removable tubing section 106, the removable tubing section 106 may be disconnected from the connectors 8*a* and 8*b* and a tool may be connected to the connectors 8*a* and 8*b* as described herein. Multiple removable sections of tubing 106 may be positioned along the tubing string 106 to permit the connection of multiple tools along the tubing string 106 as would be appreciated by one of ordinary skill in the art having the benefit of this disclosure. The removable section of tubing 106 may be of a predetermined length required to permit the connection of a tool to the tubing string 6. For example, the removable section of tubing 106 may be less than 10 feet long. The removable section of tubing 106 may only be 2 to 3 feet long. The length of the removable section of tubing 106 may be varied depending on the application as would be appreciated by one of ordinary skill in the art having the benefit of this disclosure. The removable section of tubing 106 may be a section of coiled tubing or can be any section of tubing that has substantially the same diameter and wall thickness as the coiled tubing string 6. The strength and elongation of the removable section of tubing 106 may also be comparable, but not necessarily identical, as the strength and elongation of the coiled tubing string 6.

As discussed above, the removable section of tubing 106 may be removed to permit the connection of a tool to the coiled tubing string 6. Various types of downhole tools may be connected to the tubing string 6. For example, the tools may be, but is not limited to, a water pulse hammer tool, a rotary tool, a tractor, a circulating sub, or a gas lift sub. The tools may be connected to the tubing string 6 by an upper connecting tube and a lower connecting tube. The lower end of the upper connecting tube may be connected to an upper portion of the tool. For example, the lower end of the upper connecting tube may include a threaded profile permitting the upper connecting tube to be threaded into a corresponding threaded opening in the tool. The upper end of the upper connecting tube may include a tube profile and may be connected to the coiled tubing string 6 by a crimping tool to create a dimple connection, as is well known in the art. The upper end of the lower connecting tube may be connected to a lower portion of the tool. For example, the upper end of the lower connecting tube may include a threaded profile permitting the lower connecting tube to be threaded into a corresponding threaded opening in the tool. The lower end of the lower connecting tube may include a tube profile and may be connected to the coiled tubing string 6 by a crimping tool to create a dimple connection, as is well known in the art. Various other mechanisms may be used to connect the tool to the coiled tubing string 6 as would be recognized by one of ordinary skill in the art having the benefit of this disclosure.

Figure 4:
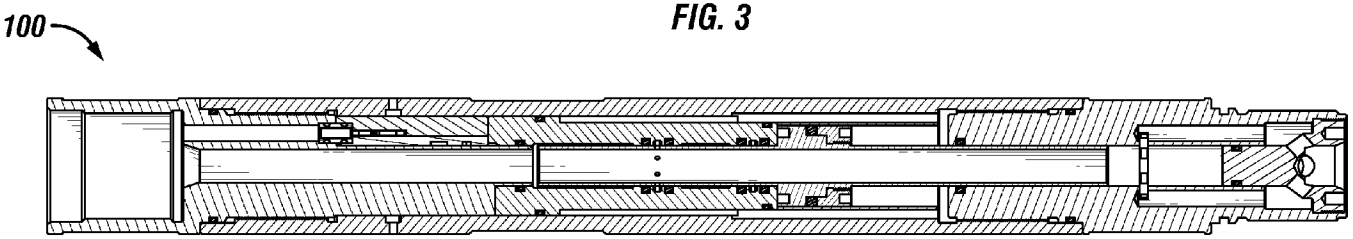
FIG. 4 is a cutaway top view of a water hammer pulse tool that may be connected along a coiled tubing string.
Figure 5:
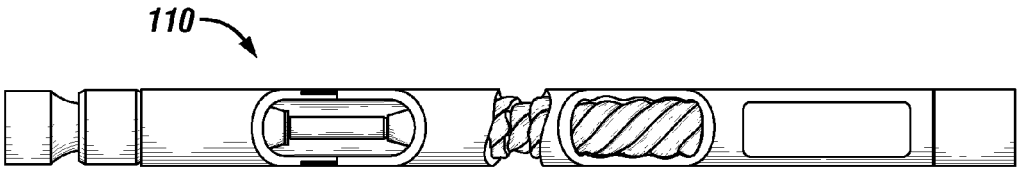
FIG. 5 shows an example of a rotary tool that may be connected along a coiled tubing string.

FIG. 4 shows one example of a water hammer pulse tool 100 that may be connected to the coiled tubing string 6 after removal of a removable tubing section 106. The water hammer pulse tool 100 may aid in the insertion of the coiled tubing string 6 into a wellbore. FIG. 5 shows one example of a rotary tool 110 that may be connected to the coiled tubing string 6 after removal of a removable tubing section 106.

Figure 6:
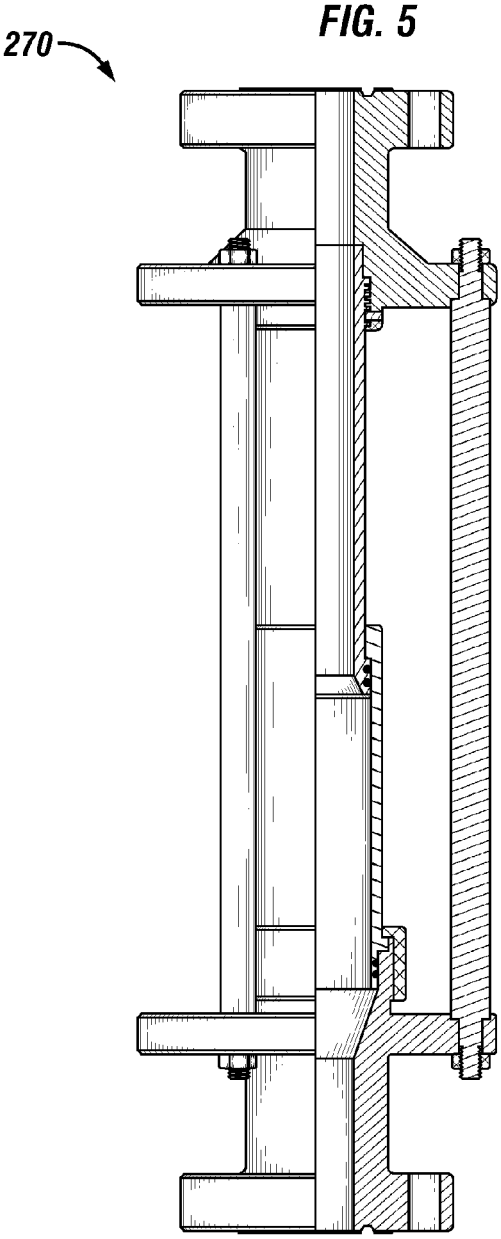
FIG. 6 shows an example of a hydraulic style work window through which a tool may be inserted to be spliced onto a coiled tubing string.

FIG. 6 shows a hydraulic actuated work window 270 that may be used to access the coiled tubing string 106 to remove the removable tubing section 106 and install a tool along the coiled tubing string 6. The coiled tubing string 6 including spoolable connectors 8 that connect a removable tubing section 106 along the coiled tubing string 6 may be stored on a reel as shown in FIG. 7. The coiled tubing string 6 is unreeled over a gooseneck 210 and through a coiled tubing injector head 220 as shown in FIG. 6 and FIG. 7. The coiled tubing string 6 continues to travel through a stuffing box 230, lubricator 240, and blow out preventer (BOP) 250 into the wellbore. One of ordinary skill in the art will recognize that that the figures may not be drawn to scale. For example, the lubricator 240 of FIG. 7 may be at least twice the length of the BOP 250 to accommodate a tool.

The coiled tubing string 6 may continue to travel off of the reel 200 until the removable tubing section 106 and connectors 8 are located within a work window 270 positioned above the BOP 250. Upon the removable tubing section 106 reaching the work window 270, slip rams of the BOP 250 may be actuated to secure the coiled tubing string 6 in place and seal rams of the BOP 250 may be actuated to create a seal on the exterior of the coiled tubing string 6. The work window 270 may then be opened to access the upper and lower connectors 8*a* and 8*b* securing the removable tubing section 106 along the coiled tubing string 6. The removable tubing section 106 may then be disconnected from the connectors 8*a* and 8*b*. For example, dimples connecting the removable tubing section 106 to the connectors 8*a* and 8*b* may be machined out permitting the removable of the removable tubing section 106. A tool may be then inserted through the work window 270 and connected to the coiled tubing string 6 via the upper and lower connectors 8*a* and 8*b*. For example, a crimping tool may connect the connecting tubes to the connectors 8*a* and 8*b* via a dimple connection. The work window 270 may then be closed, the BOP 250 may release the coiled tubing string 6, and the coiled tubing string 6 may be run into the wellbore with the tool, such as a water hammer pulse tool 100, positioned along the coiled tubing string 6.

Various other methods may be used to access the removable tubing section 106 and install a tool along the coiled tubing string 6. For example, after the connectors 8*a* and 8*b* have passed through the injector 220, stuffing box 230, and lubricator 240, the slip rams and seal rams BOP 250 may be actuated to retain and seal the coiled tubing string 6. The injector 220, stuffing box 230, and lubricator 240 may then be disconnected and raised with a hook 260 of a crane to expose the connectors 8*a* and 8*b* and the removable tubing section 106. The removable tubing section 106 may then be removed and a tool, such as a rotary tool 110, may then be connected to the coiled tubing string 106 via the connectors 8*a* and 8*b*. The injector 220, stuffing box 230, and lubricator 240 may then be lowered into position and reconnected. The rams of the BOP 250 may then be deactivated releasing the coiled tubing string 6, which may then be used to run the tool into the wellbore.

Figure 9:
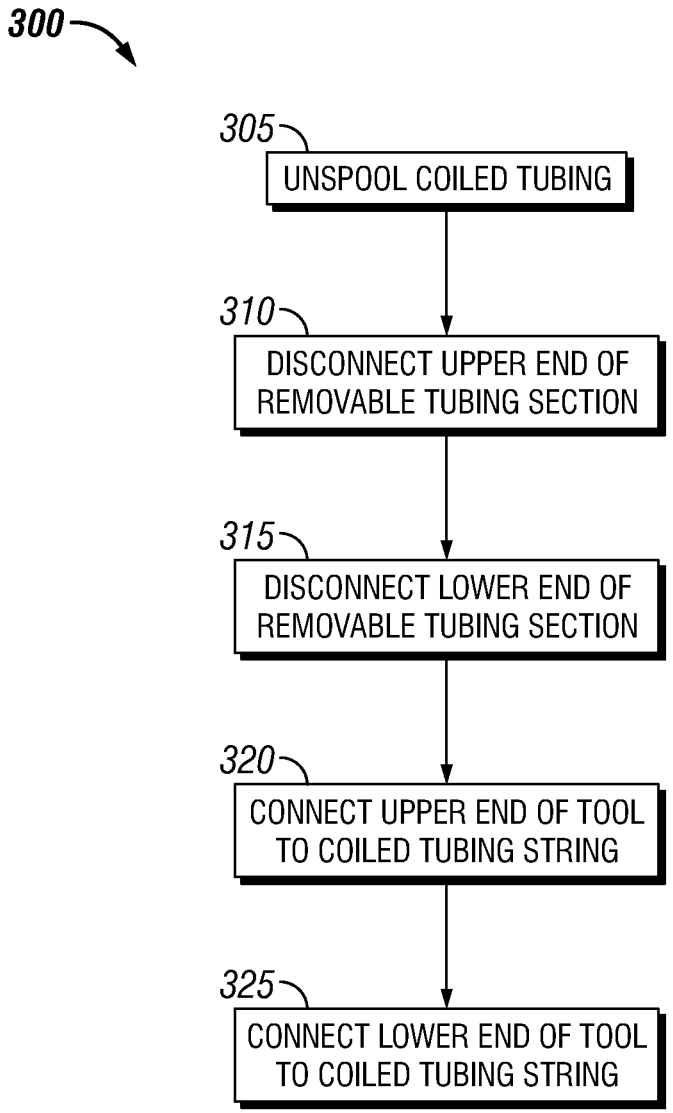
FIG. 9 is a flow chart for one embodiment of a method for splicing a tool along a coiled tubing string.

FIG. 9 shows one embodiment of a method 300 for splicing a tool along a coiled tubing string. The method 300 includes the step 305 of unspooling the coiled tubing string from a reel, the coiled tubing string comprising a lower coiled tubing string connected to a lower connector, an upper coiled tubing string connected to an upper connector, and a removable tubing section connected between the lower and upper connectors. The method 300 includes the step 310 of disconnecting an upper end of the removable tubing section from the upper connector and the step 315 of disconnecting a lower end of the removable tubing section from the lower connector. The method 300 includes the step 320 of connecting an upper portion of the tool to the upper connector and the step 325 of connecting a lower portion of the tool to the lower connector. The steps 310 and 315 of disconnecting the removable tubing section may further comprise machining out dimples from the removable tubing section. The steps 320 and 325 of connecting the tool may further comprise crimping the upper portion of the tool with a portion of the upper connector and crimping the lower portion of the tool with a portion of the lower connector.

Figure 10:
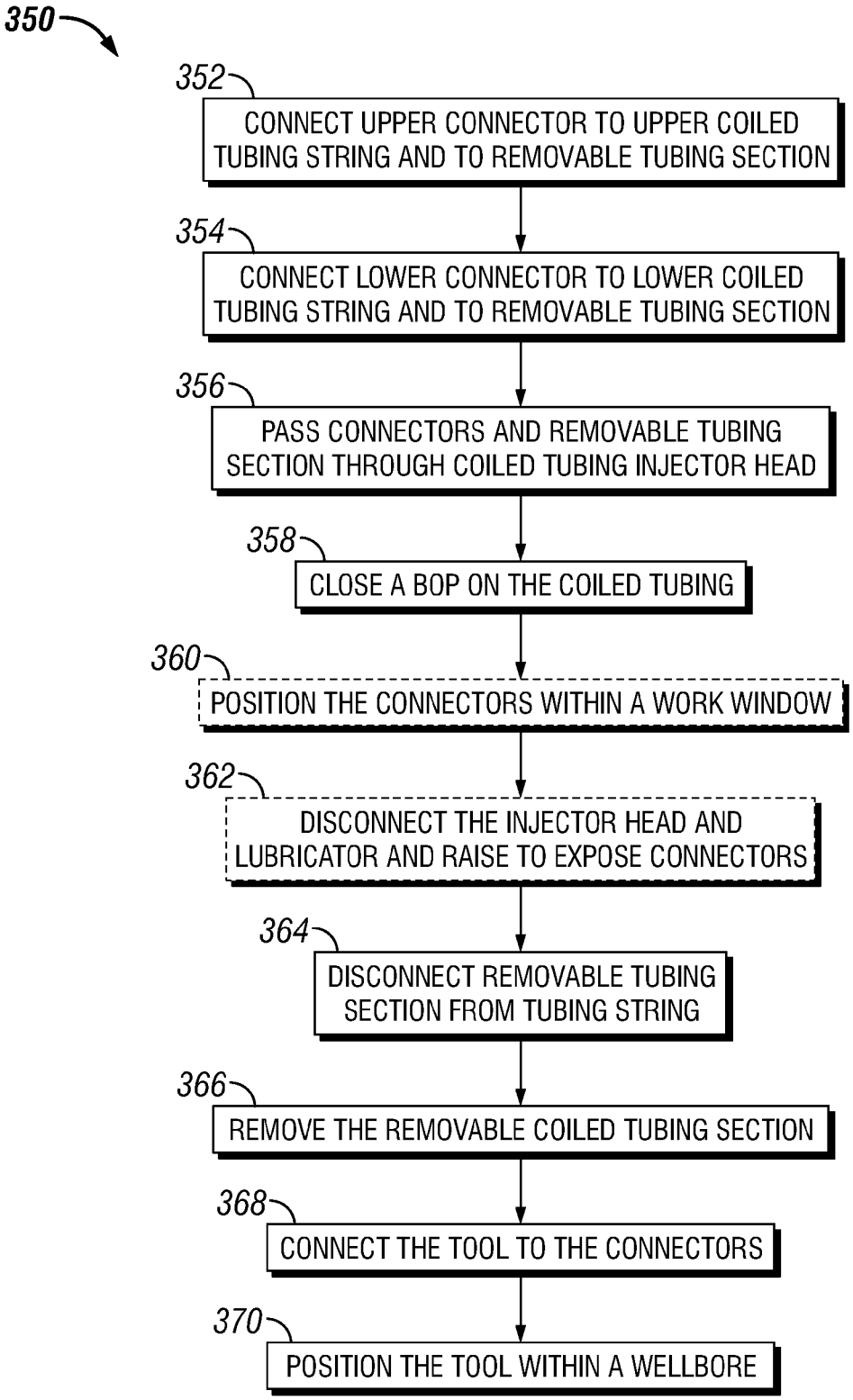
FIG. 10 is a flow chart for one embodiment of a method for splicing a tool along a coiled tubing string.

FIG. 10 shows one embodiment of a method 350 for splicing a tool along a coiled tubing string. The method 350 includes the step 352 of connecting an upper connector to an upper coiled tubing string and an upper portion of a removable coiled tubing section and the step 354 of connecting a lower connector to a lower coiled tubing string and a lower portion of the removable coiled tubing section to form a coiled tubing string comprising the upper coiled tubing string, removable coiled tubing section, and lower coiled tubing string. The method 350 includes the step 356 of passing the lower connector, removable coiled tubing section, and upper connector through a coiled tubing injector head and the step 364 disconnecting the removable coiled tubing section from the upper connector and the lower connector. The method 350 includes the step 366 of removing the removable coiled tubing section from the coiled tubing string and the step 368 of connecting a tool to the upper connector and the lower connector. After connecting the tool, the method 350 may include the step 370 of positioning the tool within the wellbore.

The method 350 may include a step 358 of closing rams of a BOP. The closure of the rams may secure the position of the coiled tubing string within the BOP and create a seal against an exterior of the coiled tubing string within the BOP. Step 358 may be performed prior to step 366 the removal of the removable coiled tubing section. The method 350 may include the step 360 of positioning the connectors and removable tubing section within a work window. Alternatively, the method 350 may include the step 362 of disconnecting an injector head and lubricator and raising these components to expose the connectors and removable tubing section.

Figure 11:
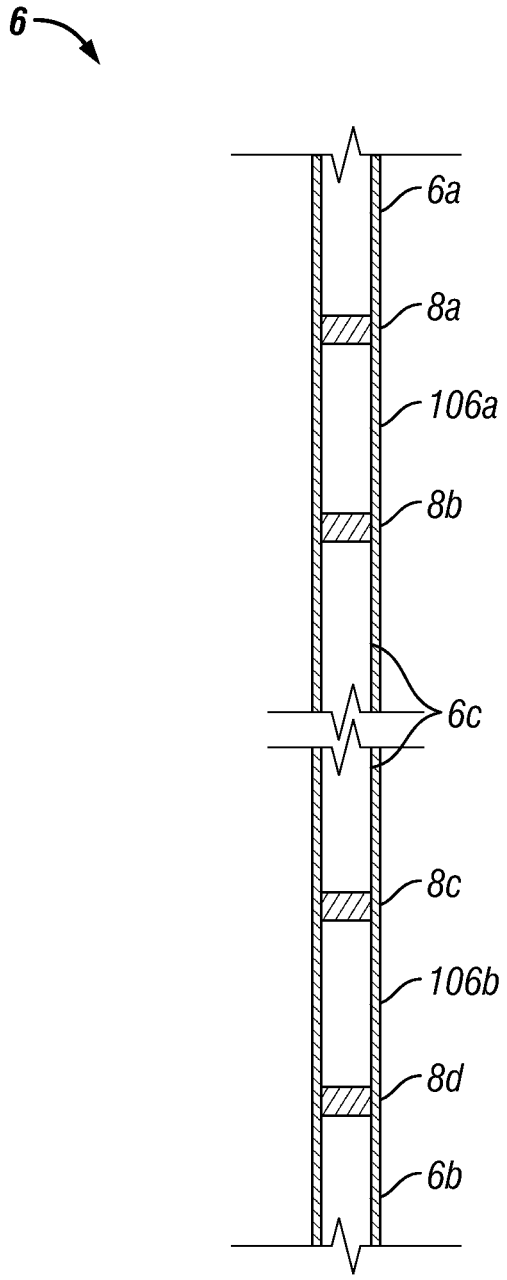
FIG. 11 shows a coiled tubing string with two removable tubing sections connected along the coiled tubing string.

FIG. 11 shows a coiled tubing string 6 having two removable sections of tubing 106*a* and 106*b* connected along the tubing string 6. A first connector 8*a* connects on end of an upper portion 6*a* of the coiled tubing string 6 to an end of a first removable section of tubing 106*a*. A second connector 8*b* connects the first removable tubing section 106*a* to a middle portion 6*c* of the tubing string 6. A third connector 8*c* connects an end of the middle portion 6*c* of the tubing string 6 to an end of a second removable section of tubing 106*b* and a fourth connector 8*d* connects the other end of the second removable section of tubing 106*b* to a lower portion 6*b* of the tubing string 6. The upper tubing string 6*a*, first connector 8*a*, first removable section of tubing 106*a*, second connector 8*b*, middle tubing string 6*c*, third connector 8*c*, second section of removable tubing 106*b*, fourth connector 8*d*, and lower tubing string 6*b* may be connected together to form a coiled tubing string 6 that may be spooled onto a reel 200 (shown in FIG. 7).

After unspooling the portion of the coiled tubing string 6 that includes the connectors 8*c* and 8*d* and the second removable tubing section 106*b*, the second removable tubing section 106*b* may be disconnected from the connectors 8*c* and 8*d* and a tool may be connected to the connectors 8*c* and 8*d* as described herein. Likewise, after unspooling the portion of the coiled tubing string 6 that includes the connectors 8*a* and 8*b* and the first removable tubing section 106*a*, the first removable tubing section 106*a* may be disconnected from the connectors 8*a* and 8*b* and a tool may be connected to the connectors 8*a* and 8*b* as described herein. Multiple removable sections of tubing 106 may be positioned along the tubing string 106 to permit the connection of multiple tools along the tubing string 106 as would be appreciated by one of ordinary skill in the art having the benefit of this disclosure.

The removable sections of tubing 106 may be of a predetermined length required to permit the connection of a tool to the tubing string 6. For example, the removable section of tubing 106 may be less than 10 feet long. The removable section of tubing 106 may only be 2 to 3 feet long. The length of the removable section of tubing 106 may be varied depending on the application as would be appreciated by one of ordinary skill in the art having the benefit of this disclosure. The removable section of tubing 106 may be a section of coiled tubing or can be any section of tubing that has substantially the same diameter and wall thickness as the coiled tubing string 6. The strength and elongation of the removable section of tubing 106 may also be comparable, but not necessarily identical, as the strength and elongation of the coiled tubing string 6.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A method for splicing a tool along a coiled tubing string, the method comprising:

connecting an upper connector to an upper coiled tubing string and an upper portion of a removable coiled tubing section;

connecting a lower connector to a lower coiled tubing string and a lower portion of the removable coiled tubing section to form a coiled tubing string comprising the upper coiled tubing string, removable coiled tubing section, and lower coiled tubing string;

passing the lower connector, removable coiled tubing section, and upper connector through a coiled tubing injector head;

disconnecting the coiled tubing injector head after passing the lower connector, removable coiled tubing section, and upper connector through the coiled tubing injector head;

raising the disconnected coiled tubing injector head to expose the upper and lower connectors;

disconnecting the removable coiled tubing section from the exposed upper connector and the exposed lower connector;

removing the disconnected removable coiled tubing section from the coiled tubing string; and connecting a tool to the upper connector and the lower connector after removing the disconnected removable coiled tubing section from the coiled tubing string, wherein connecting the upper and lower connectors to the removable coiled tubing section further comprises dimple connections, and disconnecting the removable coiled tubing section further comprises machining out the dimple connections.

2. The method of claim 1 further comprising:

securing the position of the coiled tubing string within a blow out preventer (BOP); and sealing against an exterior of the coiled tubing string within the BOP, wherein the securing and sealing are performed prior to disconnecting the removable coiled tubing section.

3. The method of claim 1, wherein connecting the tool to the upper connector and the lower connector further comprises connecting the tool with dimple connections.

4. The method of claim 1, wherein the tool is a rotary tool or a water hammer pulse tool.

5. The method of claim 1, wherein the tool is a circulating sub or a gas lift sub.

6. The method of claim 1 further comprising passing the lower connector, removable coiled tubing section, and upper connector through a lubricator.

* * * * *